US006311614B1

(12) United States Patent
Ogata et al.

(10) Patent No.: US 6,311,614 B1
(45) Date of Patent: Nov. 6, 2001

(54) STENCIL PRINTING MACHINE

(75) Inventors: Masaharu Ogata; Koji Nakayama, both of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/662,329

(22) Filed: Sep. 14, 2000

(30) Foreign Application Priority Data

Sep. 17, 1999 (JP) ..... 11-264471

(51) Int. Cl.[7] ..... B05C 17/04; B41L 13/18

(52) U.S. Cl. ..... 101/124; 101/116; 101/119; 101/129

(58) Field of Search ..... 101/116, 119, 101/124, 129

(56) References Cited

U.S. PATENT DOCUMENTS 3,685,442 * 8/1972 Harwell, Jr. ..... 101/119
4,388,863 * 6/1983 De Santis ..... 101/129
5,617,786 * 4/1997 Negishi ..... 101/116

FOREIGN PATENT DOCUMENTS 0 963 856 A1 12/1999 (EP) .
0 976 569 A1 2/2000 (EP) .

* cited by examiner

*Primary Examiner*—John S. Hilten
*Assistant Examiner*—Marvin P. Crenshaw
(74) *Attorney, Agent, or Firm*—Nath & Associates PLLC; Gary M. Nath; Marvin C. Berkowitz

(57) ABSTRACT

According to the stencil printing machine of the present invention, ink that has entered the gap between a circumferential wall and a stencil sheet is allowed to escape to the outsides of an inner pressing roll in the axis direction. When it reaches the outer circumferential face of an ink free passage section of a screen, the escape ink is allowed to pass through the ink free passage section by a pressing force from the pressure drum, and directed to the inner circumferential side; therefore, it is possible to prevent the escape ink from reaching the right and left ends of the stencil sheet, and consequently to eliminate the limitation to the number of prints in endurance printing processes that is imposed due to ink leakage from the stencil. Moreover, since it is not necessary to form a raised portion along the circumferential face, the printing drum can be easily manufactured at low costs.

8 Claims, 18 Drawing Sheets

STENCIL PRINTING MACHINE

BACKGROUND OF THE INVENTION

1. Field of the Invention

The present invention relates to a stencil printing machine of an inner press system in which a printing pressure is exerted from the inner circumference side of a printing drum, and also relates to a technique for preventing ink leakage from the sides of the printing drum (in the center axis direction of the printing drum).

2. Description of the Related Art

As shown in FIGS. 1 and 2, a printing section of a stencil printing machine is provided with a printing drum 100 and a pressure drum 101, and the printing drum 100 and the pressure drum 101 are respectively installed so as to freely rotate, with respective portions of their outer circumferential faces being closely located with each other. The printing drum 100 is provided with a pair of cylindrical flanges (not shown) aligned face to face with each other with a predetermined gap, and a stencil sheet clamp section 100*a*, which clamps the leading edge of a stencil sheet 104, is placed on a part of the outer circumferential face of each flange. A flexible screen 102 is stretched over the outer circumferential faces of the flanges of the printing drum 100 other than the stencil sheet clamp section 100*a*.

As shown in FIGS. 3 and 4, the screen 102, which forms a circumferential wall of the printing drum, consists of an area which is subjected to a pressing force applied by an inner pressing roll 106 and which is constituted by a rough mesh screen section 102*a* and a dense mesh screen section 102*b* that are overlapped with each other so as to form a pressing-time ink passage section 112 (indicated by a diagonal hatched portion in FIG. 3) through which ink 103 is only allowed to pass upon application of the pressing force, and an area which is not subjected to the pressing force and which is formed by the rough mesh screen section 102*a* to which a coating material is injected so as to provide an ink non-passage section 113 (indicated by a cross hatched portion in FIG. 3) through which no ink 103 is allowed to pass even upon application of the pressing force. All the circumferential portion of the dense mesh screen section 102*b* is affixed to the rough mesh screen section 102*a* through a bonding section 102*c* formed by using the coating material injected to the rough mesh screen section 102*a* as a bonding agent. On the inner circumferential face of the screen 102 as well as on the ink non-passage section 113 located on one of the outer circumferential sides of the pressing-time ink passage section 112, a raised portion 114*a* is formed, and on the other outer circumferential side that is rotation-delay side of the ink non-passage section 113 of the pressingtime ink passage section 12, a raised portion 114*b* is formed. In other words, on the Inner circumferential face of the screen 102, the raised portions 114*a* and 114*b* are formed in a U-letter shape.

Moreover, an inner press mechanism 105 is installed inside the screen 102 forming the circumferential wall of the printing drum 100. The inner press mechanism 105 is provided with an inner pressing roll 106, and this inner pressing roll 106 is formed on a roll support member 107 so as to freely rotate thereon. This roll support member 107 is supported so as to freely pivot centered on a support shaft 108 so that the inner pressing roll 106 is allowed to shift between a pressing position at which the inner pressing roll 106 is allowed to press the inner circumferential face of the screen 102 with the roll support member 107 being pressed in the direction of arrow a in FIG. 2, and a stand-by position at which the inner pressing roll 106 is apart from the inner circumferential face of the screen 102 with the roll support member 107 being rotated in the direction of arrow b in FIG. 2. The inner pressing roll 106 is located at the pressing position at the time of printing and is also located at the stand-by position in cases other than the printing process.

Moreover, a doctor roll 109 and a driving rod 110 are respectively installed on the roll support member 107. The doctor roll 109 has a column shape, and is secured to the roll support member 107 in the vicinity of the inner pressing roll 106. The driving rod 110 is supported on the roll support member 107 so as to freely rotate thereon and is placed in an upper space that is formed by the outer circumferential faces of the inner pressing roll 106 and the doctor roll 109 on the respective sides located close to each other. Ink 103 is supplied to this upper space from an ink supplying section, not shown.

Next, an explanation will be given of the outline of the printing operation in succession. A stencil sheet 104 is subjected to a stencil making process by forming perforations in predetermined positions thereof, and the leading edge of the stencil sheet 104 thus subjected to the stencil making process is clamped by a stencil sheet clamp section 100*a* of the printing drum 100, and attached to the outer circumferential face of the screen 102 forming the circumferential wall of the printing drum 100. Next, the printing drum 100 and the pressure drum 101 are rotated in a direction indicated by an arrow in FIG. 1 in synchronism with each other. Moreover, at the time of printing, the inner pressing roll 106 is allowed to press the screen 102, and in this pressing state, the inner pressing roll 106 is rotated following the printing drum 100. Ink 103, which has passed through the gap against the doctor roll 109, is allowed to adhere to the outer circumferential face of the inner pressing roll 106, and the adhering ink 103 is successively transferred onto the inner circumferential face of the screen 102 by the rotation of the inner pressing roll 106. Moreover, the screen 102 is expanded to the outer circumferential side by the pressing force of the inner pressing roll 106 so that the screen 102 is made in contact with the pressure drum 101.

In this state, as shown in FIG. 1, a sheet of printing paper 111 is transported to the gap between the printing drum 100 and the pressure drum 101, and the sheet of printing paper 111 is successively transported by the printing drum 100 and the pressure drum 101.

The printing paper 111, transported between the printing drum 100 and the pressure drum 101, is further transported while being pressed between the inner pressing roll 106 and the pressure drum 101 together with the screen 102 and the stencil sheet 104. This pressing force allows the ink 103 on the screen 102 side to be transferred onto the printing paper 111 side through the perforations of the stencil original paper 104 so that a printing process in accordance with an image formed on the stencil sheet 104 is carried out.

In the above-mentioned printing operation, the inner pressing roll 106 supplies ink 103 to the inner circumferential face of the screen 102, and also presses the screen 102 so as to exert a pressing force thereon, while pressing the raised portions 114*a* of the screen 102 at both of the ends of the inner pressing roll 106 so that side leakage of the ink 103 (ink leakage in the center axis direction of the printing drum) is prevented.

More specifically, as shown in FIG. 5, some of the ink 103 located between the inner pressing roll 106 and the rough mesh screen section 102*a* is not allowed to escape outwards in the axial direction of the inner pressing roll 106, since the inner pressing roll 106 presses the raised portions 114*a* so as to form a closely contact state between the inner pressing roll 106 and the raised portions 114*a*. Some of the ink 103 located between the rough mesh screen section 102*a* and the dense mesh screen section 102*b* is blocked in its shift outwards in the axial direction of the inner pressing roll 106 by a bonding section 102*c* so that it is not allowed to escape in the axial direction of the inner pressing roll 106. Moreover, some of the ink 103 located between the dense mesh screen section 102*b* and the stencil sheet 104 is not allowed to escape outwards in the axial direction of the inner pressing roll 106, since the inner pressing roll 106 presses the raised sections 114*a* from above so that the pressing force forms a closely contact state between the dense mesh screen section 102*b* and the stencil sheet 104. With the above-mentioned arrangements, side leakage of the ink 103 on the inner circumferential side as well as on the outer circumferential side of the screen 102 is prevented.

However, as shown in FIG. 6, when the raised portions 114*a*, etc. are worn out after a long time use, the pressing force of the inner pressing roll 106 applied to the raised portions 114*a* becomes weaker, and in the worst case, it hardly exists. As a result, since the closely contact state between the dense mesh screen section 102*b* and the stencil sheet 104 is no longer maintained, the ink 103 located between the dense mesh screen section 102*b* and the stencil sheet 104 is allowed to escape outwards in the axial direction of the inner pressing roll 106. Then, the amount and spread of the ink 103 escaping in the axial direction of the inner pressing roll 106 increase in proportion to the number of the printing operations, with the result that when the ink 103 has reached the right and left ends of the stencil sheet 104, the ink 103 stains the pressure drum 101, etc. Therefore, because of the ink leakage from the sides of the screen 102, a limitation has to be imposed on the number of prints in endurance operations (the number of prints with guaranteed quality for one sheet of stencil sheet 104).

Moreover, as the wear of the raised portions 114*a* develops, the ink 103 located between the inner pressing roll 106 and the rough mesh screen section 102*a* escapes outwards in the axial direction of the inner pressing roll 106 over the raised portions 114*a*, and since the escaped ink 103 gradually accumulates on the inner circumferential face of the screen 102, resulting in problems such as stains inside the machine due to leakage ink.

Furthermore, in the conventional screen 102, it is necessary to provide the raised portions 114*a* in addition to the structures such as the mesh screen section 102*a* and 102*b*; therefore, the manufacturing process becomes complex with high costs.

SUMMARY OF THE INVENTION

The present invention has been devised to solve the above-mentioned problems, and its object is to provide a stencil printing machine which can eliminate the limitation to the number of prints in endurance printing processes that is imposed due to ink leakage from the printing drum side portions, and which allows a printing drum to be manufactured easily at low costs, and which is also free from problems such as stains inside the machine due to ink leakage from the inner circumferential face of the printing drum.

One of the features of the present invention is that, in a stencil printing machine in which: a printing drum and a pressure drum are installed so as to be freely rotated with respective portions on the outer circumferential faces being virtually located closely; a stencil sheet is detachably attached onto the outer circumferential wall face of the printing drum; an inner pressing roll, which supplies ink from the inner circumferential face side of the circumferential wall, is supported inside the circumferential wall so as to freely rotate thereon, the inner pressing roll being allowed to freely press the inner circumferential face of the circumferential wall; the printing drum and the pressure drum are allowed to rotate so that the respective closely-located outer circumferential faces are shifted in the same direction; and the inner pressing roll is allowed to press the inner circumferential face of the circumferential wall so that this pressing force allows the stencil sheet attached to the circumferential wall and a printing medium passing through the stencil sheet and the pressure drum to contact each other, thereby carrying out a stencil printing process, the above-mentioned circumferential wall is constituted by a pressing-time ink passage portion which allows ink to pass through an area pressed by the inner pressing roll with the pressing force being applied thereto, an ink free passage portion that is located on the respective outside areas of the pressing-time ink passage portion in the direction of the center axis line of the printing drum and that allows ink to pass through it even in a state where no pressing force is applied thereto, and an ink non-passage portion that is located the respective further outside areas of the ink free passage portion and that does not allow the ink to pass through it even when the pressing force is exerted thereon.

With this arrangement, ink, located between the circumferential wall of the printing drum and the stencil sheet, is allowed to escape outward in the axial direction of the inner pressing roll by a pressing force exerted between the inner pressing roll and the pressure drum, and when the ink has reached a position on the outer circumferential face of the ink free passage portion of the circumferential wall of the printing drum, the escape ink is allowed to pass through the ink free passage portion by the pressing force from the pressure drum, and directed to the inner circumferential face side; thus, no escape ink is allowed to reach the right and left ends of the stencil sheet, and it is not necessary to provide a raised portion along the circumferential wall.

It is preferable to install an ink return unit for returning the ink stored on the inner face side of the ink free passage portion of the circumferential wall to a position at which the ink is re-used.

In this arrangement, the ink, stored on the inner face side of the ink free passage portion of the circumferential wall, is returned to the position at which the ink is re-used by the ink return unit.

Also, it is preferable that the ink return unit is provided with an ink passage that is formed between the roll supporting member for supporting the inner pressing roll so as to freely rotate thereon and the side end face of the inner pressing roll; thus, ink adhering to the side end face of the inner pressing roll is raised upward by the rotation of the inner pressing roll and allowed to rise through the ink passage, and the surface tension of the ink thus raised upward serves to raise the ink located below successively so that the ink is allowed to rise through the ink passage, and directed to the outer circumferential face side above the inner pressing roll.

In this arrangement, of the ink accumulated on the inner circumferential side of the ink free passage portion of the circumferential wall, the ink adhering to the side end face of the inner pressing roll is raised upward by the rotation of the inner pressing roll, and allowed to rise through the ink passage, and the surface tension of the ink thus raised upward serves to raise the ink located below successively so that the ink is allowed to rise through the ink passage, and directed to the outer circumferential face side above the inner pressing roll.

And also it is desirable to install an ink wiping member which is placed inside the printing drum, on the rotation downstream side of the printing drum with respect to the inner pressing roller, and which returns ink flowing over the ink non-passage portion to the ink free passage portion.

In this arrangement, of the ink accumulated on the inner circumferential side of the ink free passage portion of the printing drum, the ink flowing over the ink nonpassage portion is wiped by the ink wiping member, and returned to the ink free passage portion.

Other and further objects and features of the present invention will become obvious upon understanding of the illustrative embodiments about to be described in connection with the accompanying drawings or will be indicated in the appended claims, and various advantages not referred to herein will occur to one skilled in the art upon employing of the invention in practice.

BRIEF DESCRIPTION OF DRAWINGS

FIG. 16A is a cross-sectional view taken along the line A—A of FIG. 15 and FIG. 16B is a cross-sectional view taken along the line B—B of FIG. 15.

DETAILED DESCRIPTION OF THE PREFERRED EMBODIMENTS

Figure 1:
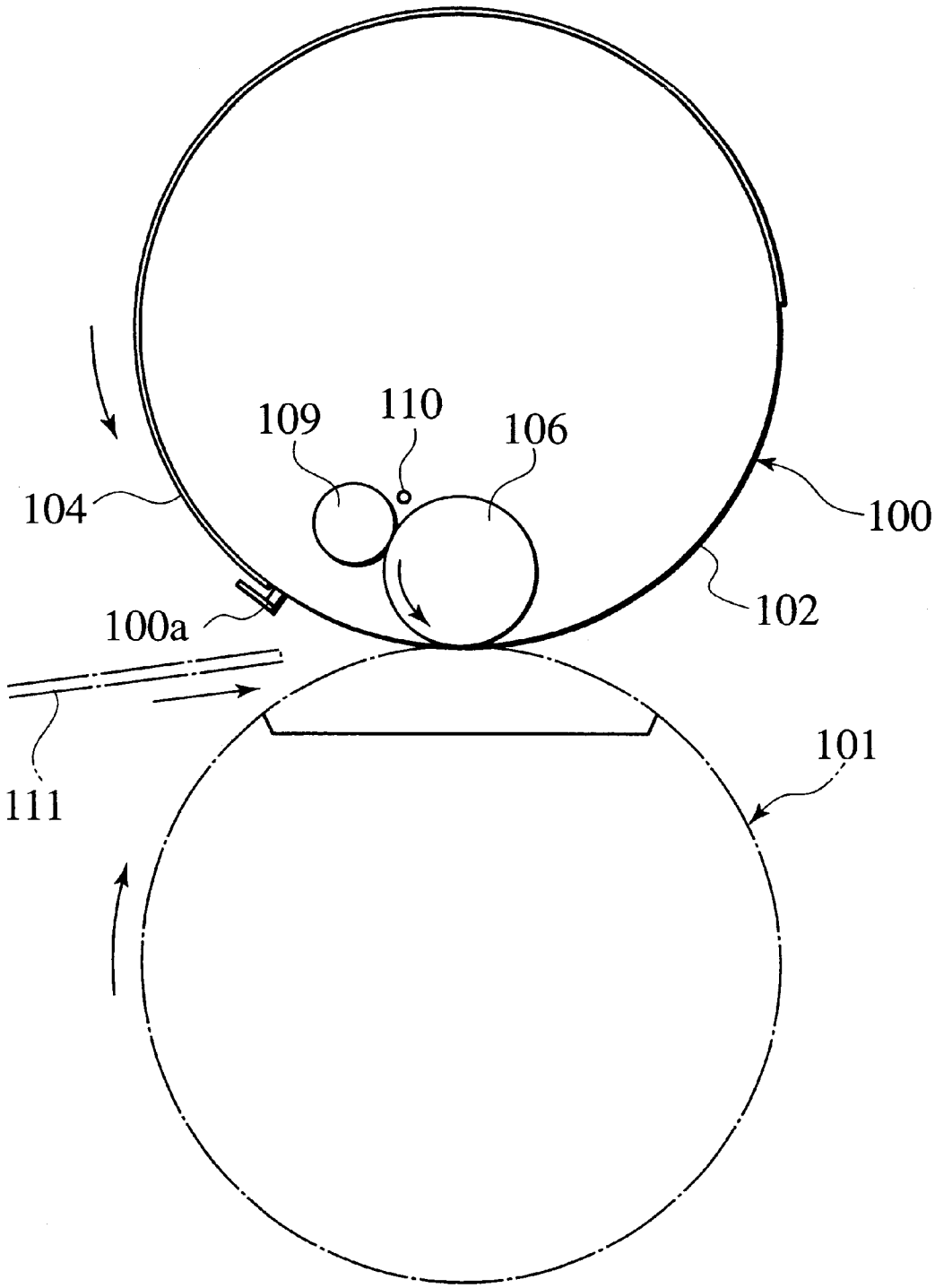
FIG. 1, which shows a conventional example, is a structural diagram showing one portion of a printing section of a stencil printing machine.
Figure 2:
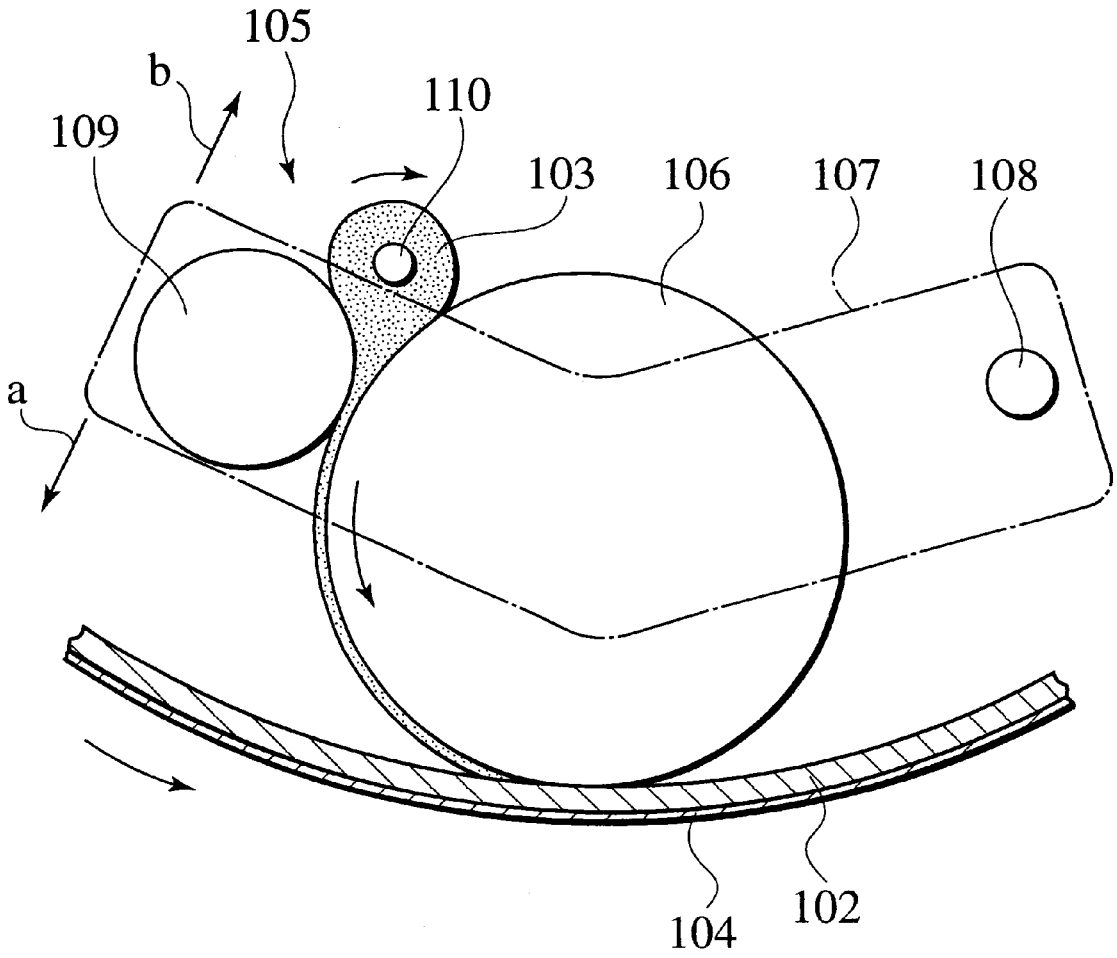
FIG. 2, which shows the prior art structure, is a cross-sectional view showing a mechanism for supplying ink to the printing section.
Figure 3:
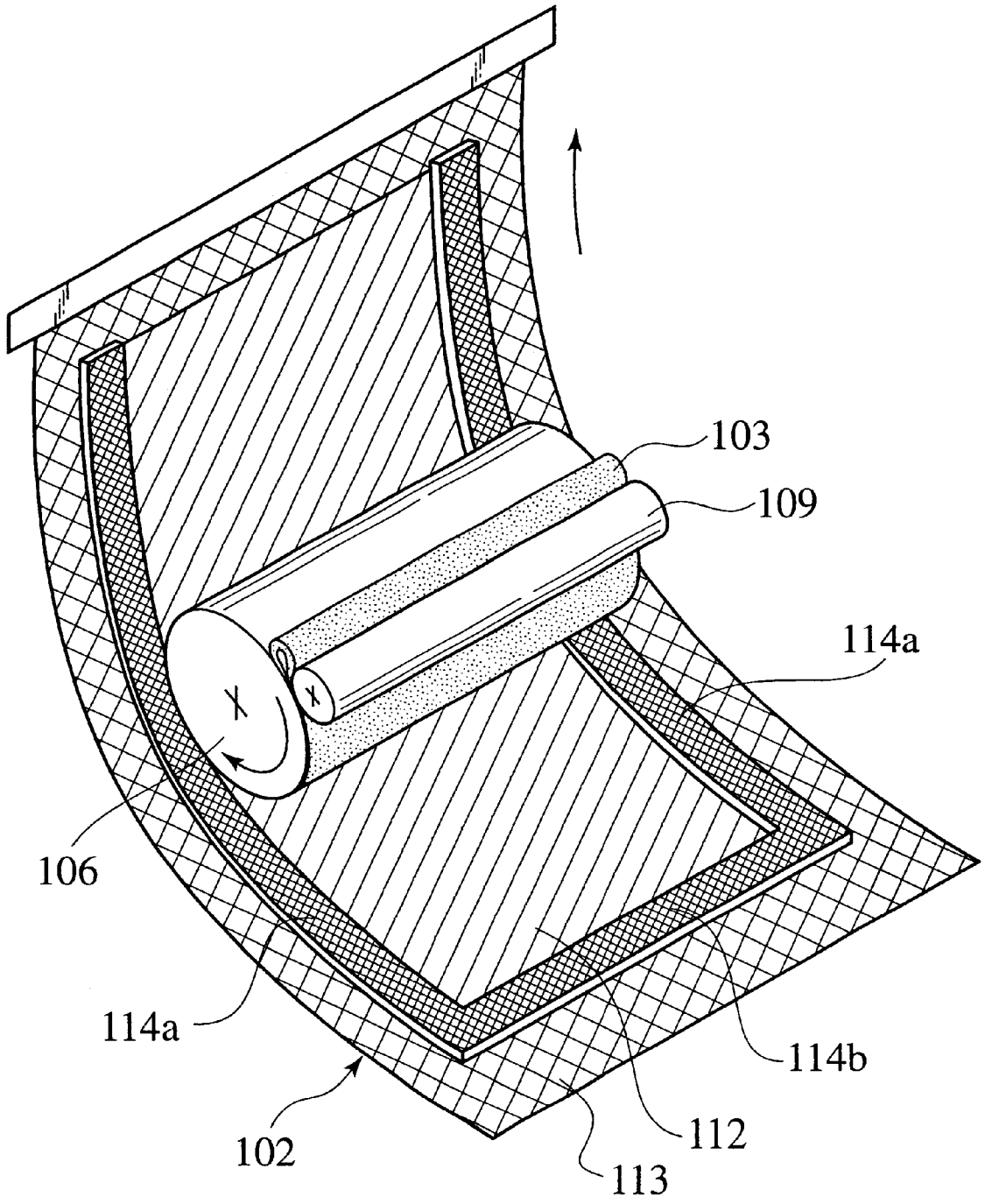
FIG. 3, which shows the prior art structure, is a perspective view showing members such as an inner pressing roll and a developed screen.
Figure 4:
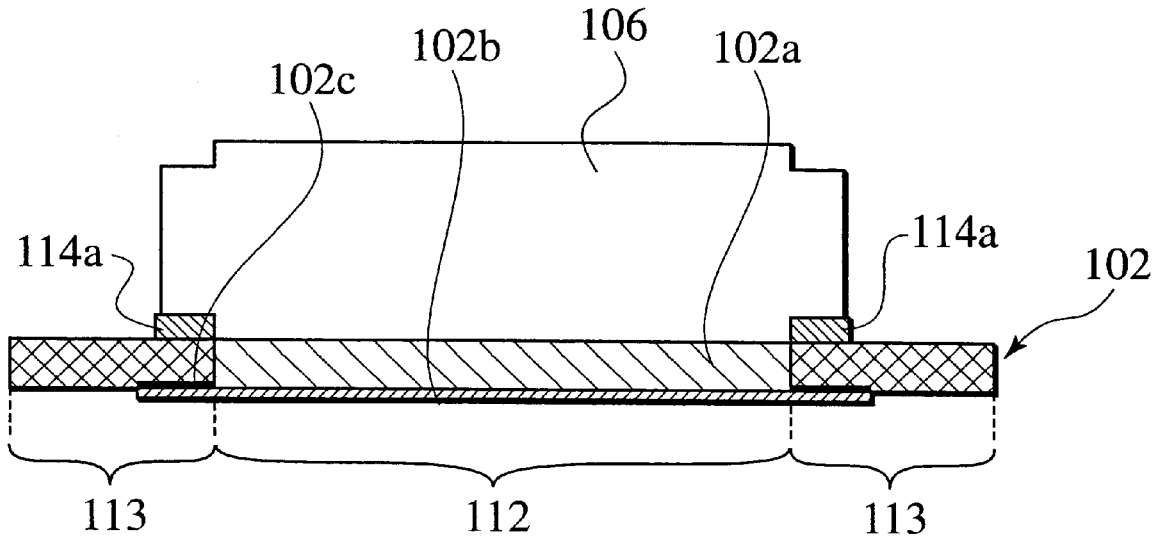
FIG. 4, which shows the prior art structure, is a cross-sectional view showing the inner pressing roll and the screen.
Figure 5:
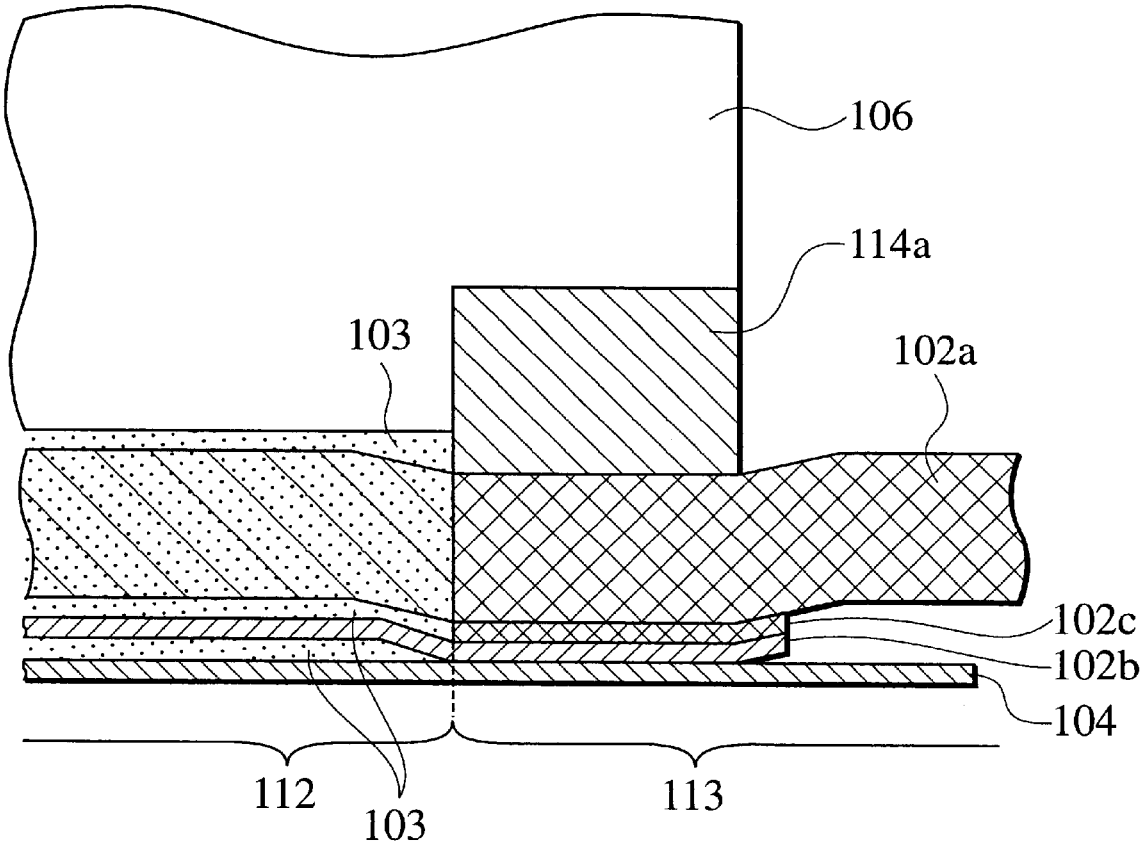
FIG. 5, which shows the prior art structure, is a cross-sectional view of an essential portion showing a state in which the inner pressing roll is pressing the raised portion of the screen.
Figure 6:
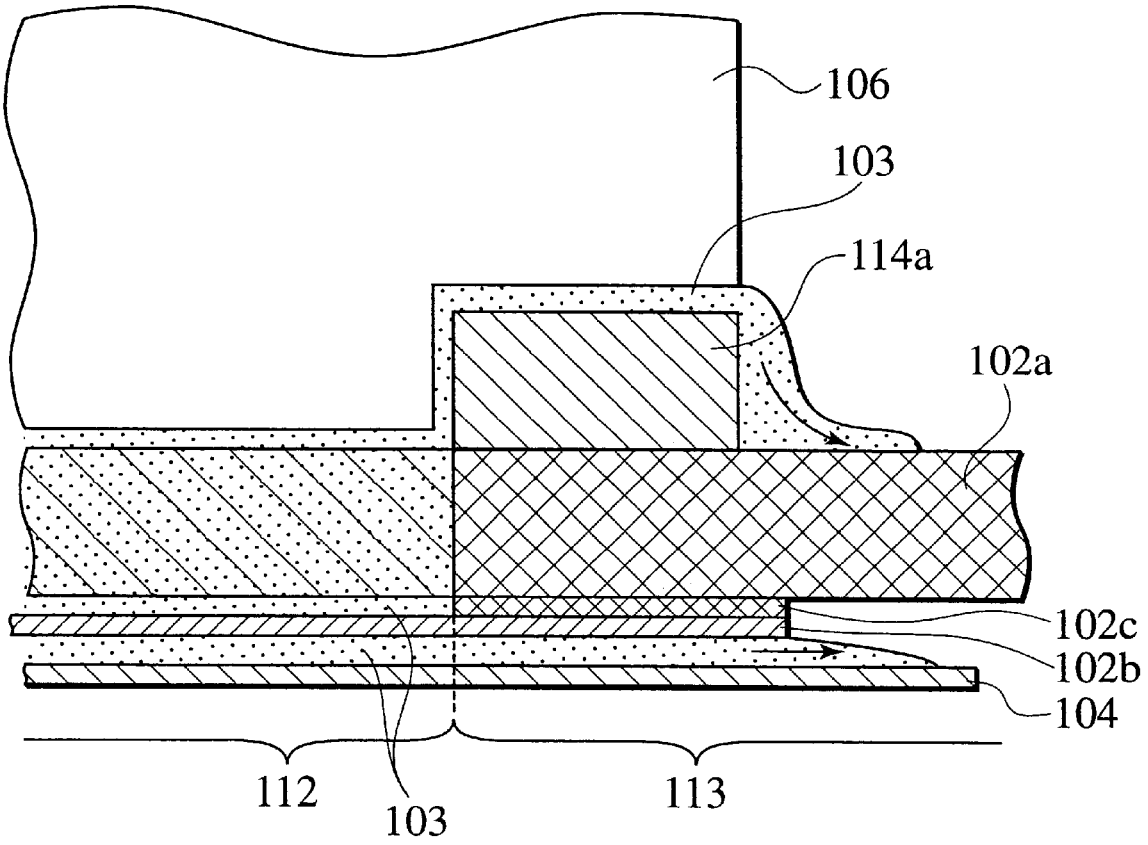
FIG. 6, which shows the prior art structure, is a cross-sectional view of an essential portion showing a state in which the raised portion of the screen is worn out, with the result that ink is allowed to flow from the respective sides of the screen.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

Figure 7:
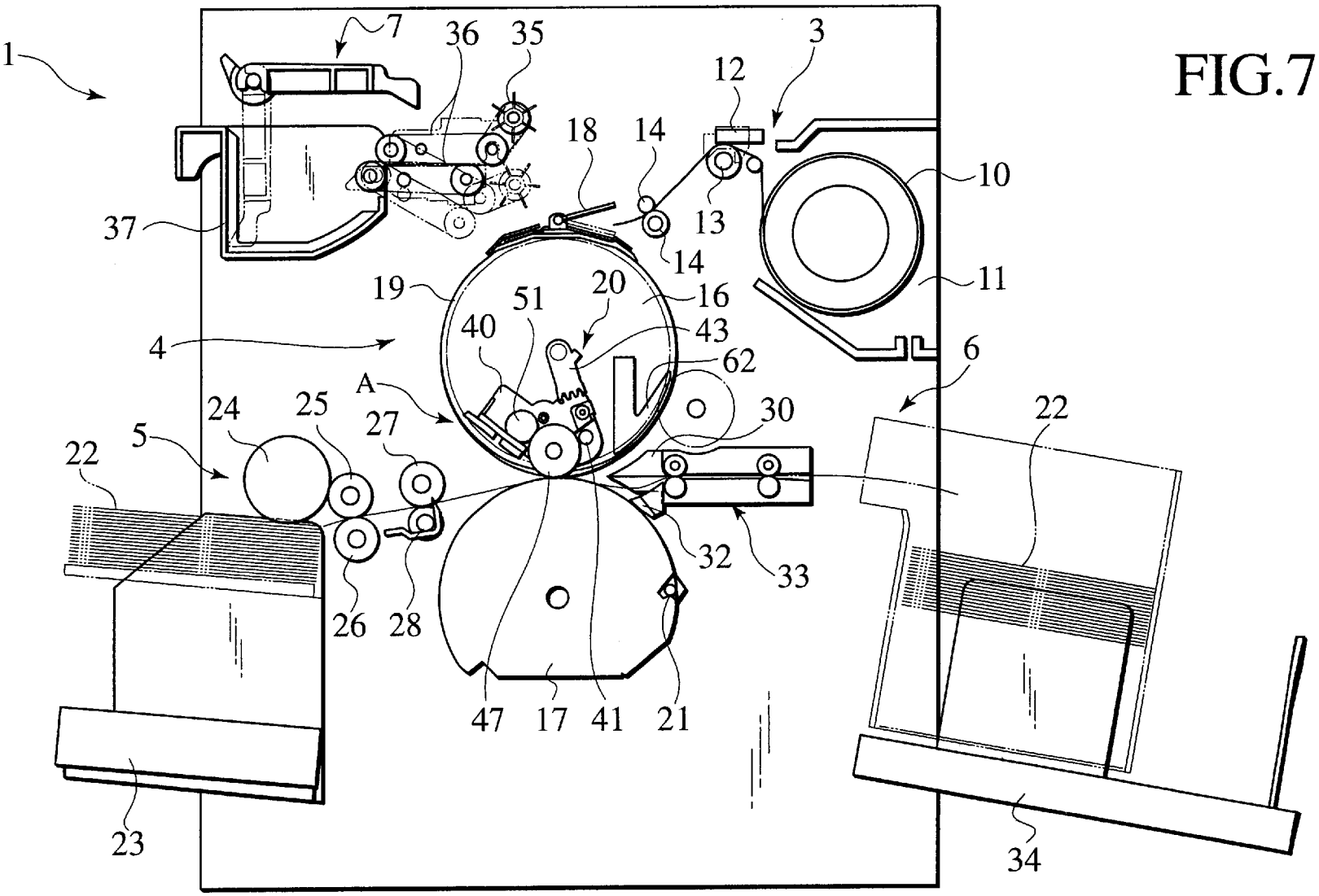
FIG. 7, which shows one embodiment of the present invention, is a schematic structural diagram showing a stencil printing machine.

As shown in FIG. 7, a stencil printing machine 1 is mainly constituted by a document-reading section (not shown), a stencil making section 3, a printing section 4, a paper feeding section 5, a paper-discharging section 6 and a stencil disposal section 7.

The document-reading section (not shown) reads a document as electric signals. The information thus read is designed so as to be processed based upon a predetermined instruction (such as enlargement, reduction, etc.).

The stencil making section 3 is constituted by a stencil sheet housing section 11 for housing an elongated stencil sheet 10 wound into a roll, a thermal head 12 placed on the downstream side of the stencil sheet housing section 11 in the transporting direction of the elongated stencil sheet 10, a platen roller 13 that is placed at a position opposing to the thermal head 12 and that is driven by a driving force of a write pulse motor (not shown), a pair of stencil sheet feeding rollers 14 that is placed on the downstream side of the platen roller 13 and the thermal head 12 in the transporting direction of the elongated stencil sheet 10 and that is driven by a driving force of a write pulse motor (not shown) and a stencil sheet cutter (not shown) that is placed between the pair of stencil sheet feeding rollers 14 and the platen roller 13 as well as the thermal head 12.

The printing section 4 is provided with a printing drum 16 and a pressure drum 17, and the printing drum 16 and the pressure drum 17 are placed so as to be freely rotated with respective portions on the outer circumferential faces virtually closely located with each other. The printing drum 16 has a pair of circular flanges that are placed face to face with each other with a predetermined gap. A stencil sheet clamp section 18 is formed on one portion of the circumferential face of the flange so that the leading edge of a stencil sheet 15 is clamped by this stencil sheet clamp section 18. Onto the outer circumferential face of the flange of the printing drum 16 except the stencil sheet clamp section 18, a flexible screen 19, which forms a circumferential wall of the printing drum 16, is attached in a stretched manner. With respect to the structure of the screen 19 forming the circumferential wall of the printing drum 16, an explanation will be given below. Inside the screen 19 of the printing drum 16, an inner pressing roll 47 of an inner press mechanism 20 is installed, and with respect to the inner press mechanism 20, a detailed explanation will be given below. Moreover, a paper clamp section 21 is placed at a predetermined position on the outer circumferential face of the pressure drum 17 so that the leading edge of a sheet of printing paper 22 that is a printing medium is clamped by the paper clamp section 21.

The paper-feeding section 5 is constituted by a paper-feeding tray 23 on which sheets of printing paper 22 are stacked, a scraper 24 for pressing and contacting the sheets of printing paper 22 on the upper-most position from the paper-feeding tray 23, a pickup roll 25 and a sorting roll 26 that are placed on the downstream side of the scraper 24 at virtually proximate positions from each other, a guide roll 27 and a timing roll 28 that are placed on the downstream side of the pickup roll 25 and the sorting roll 26 at virtually proximate positions from each other. With respect to sheets of paper 22 shifted by the rotation of the scraper 24, only one sheet of paper 22 on the uppermost position is allowed to be transported by the pickup roll 25 and the sorting roll 26, and this sheet of printing paper 22, thus allowed to be transported, is transported in synchronism with the rotation of the pressure drum 17 by the rotations of the guide roll 27 and the timing roll 28.

The paper-discharging section 6 is provided with an upper regulating guide section 30 for guiding the leading edge of a sheet of printing paper 22 that has been subjected to printing, a sheet separator claw 32 for scraping a sheet of printing paper 22 that has been stacked on the pressure drum 17, a paper-transporting mechanism 33 for transporting the sheet of printing paper 22 guided by the guiding section 30, or scraped by the sheet separator claw 32, and a stacker section 34 for placing the sheets of printing paper 22 transported by the paper-transporting mechanism 33 in an accumulated state.

The stencil disposal section 7 is provided with a discharged stencil guiding belt 35 for guiding the leading edge of the stencil sheet 15 released from the stencil sheet clamp section 18 of the printing drum 16, a pair of discharged stencil conveyor belts 36 for transporting the stencil sheet 15 directed from the discharge stencil guiding belts 35 while allowing the stencil sheet 15 to separate from the printing drum 16, and a discharged stencil box 37 for storing the stencil sheet 15 transported thereto by the pair of discharged stencil conveyor belts 36.

In FIGS. 8 through 12, the inner press mechanism 20 is provided with an inner unit 38 placed inside the printing drum 16, and torque-transmitting unit 39 for transmitting a torque to the inner unit 38, which is placed outside the printing drum 16. The inner unit 38 has a roll support member 40, and the roll support member 40 is supported by a securing member (not shown) centered on a support shaft 41 so as to freely rotate thereon. A teeth portion 42 is formed on the roll support member 40, and the teeth portion 44 of an inner arm portion 43 is engaged with the teeth portion 42. The inner arm portion 43 is supported so as to freely rotate, with a driving shaft 43*a* serving as a fulcrum, and one of the ends of the driving shaft 43*a* is allowed to stick outside from the printing drum 16. The torque from the torque transmitting unit 39 is transmitted to this driving shaft 43*a* sticking out in this manner.

Figure 10:
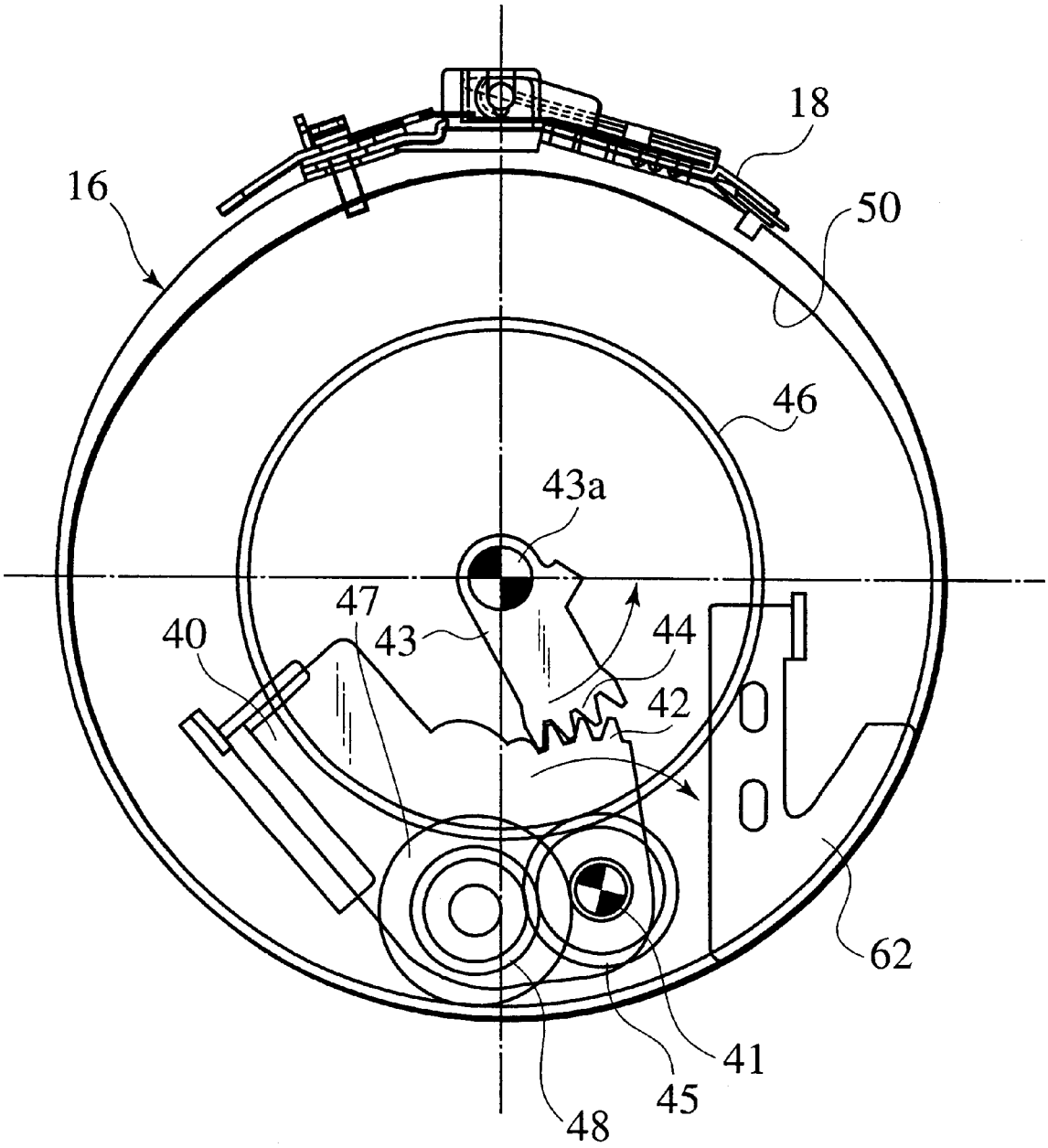
FIG. 10, which shows one embodiment of the present invention, is a structural side view showing the inside of a printing drum in which an inner pressing roll is located at a stand-by position.
Figure 11:
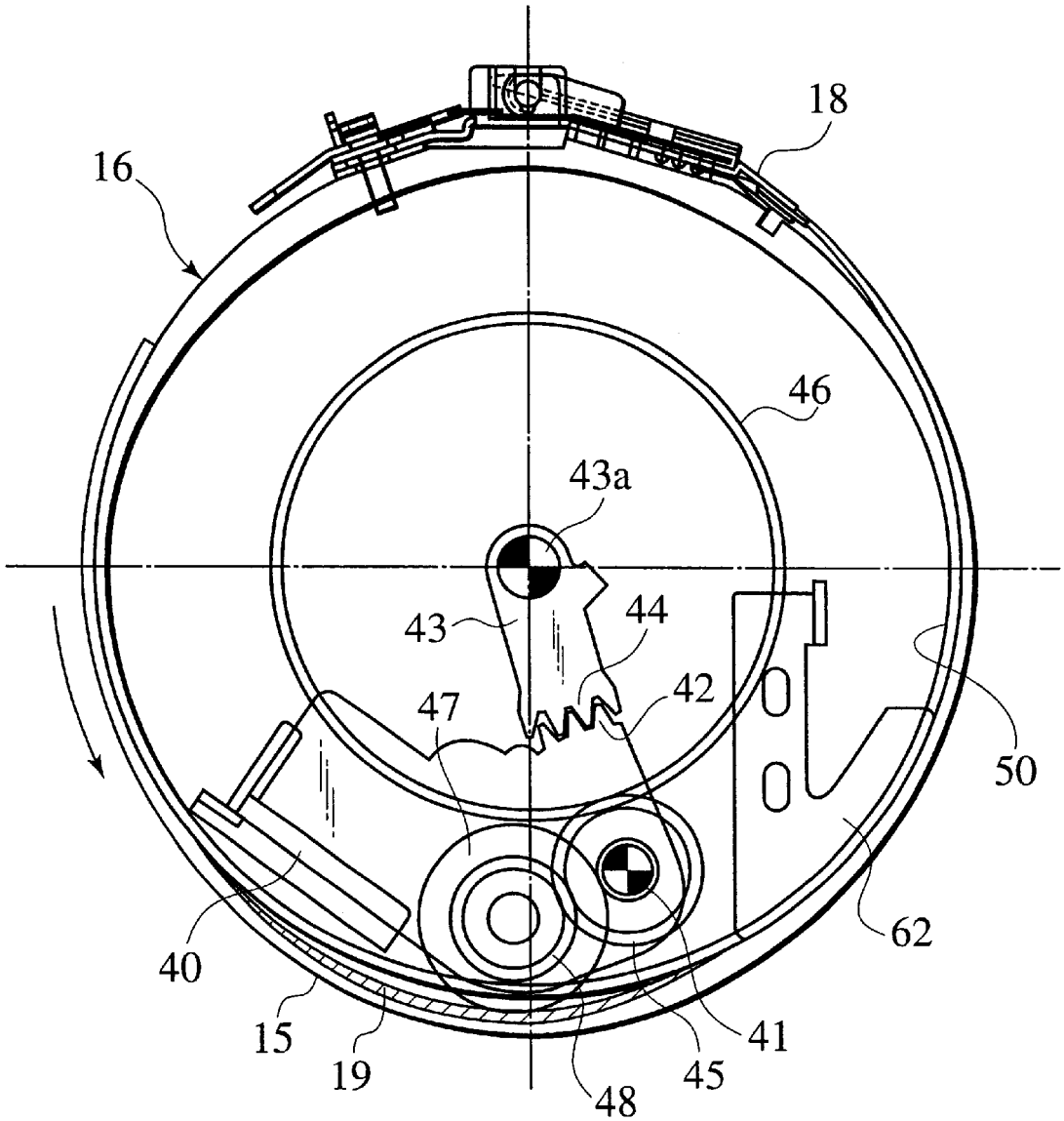
FIG. 11, which shows one embodiment of the present invention, is a structural side view showing the inside of the printing drum in which the inner pressing roll is located at a pressing position.
Figure 12:
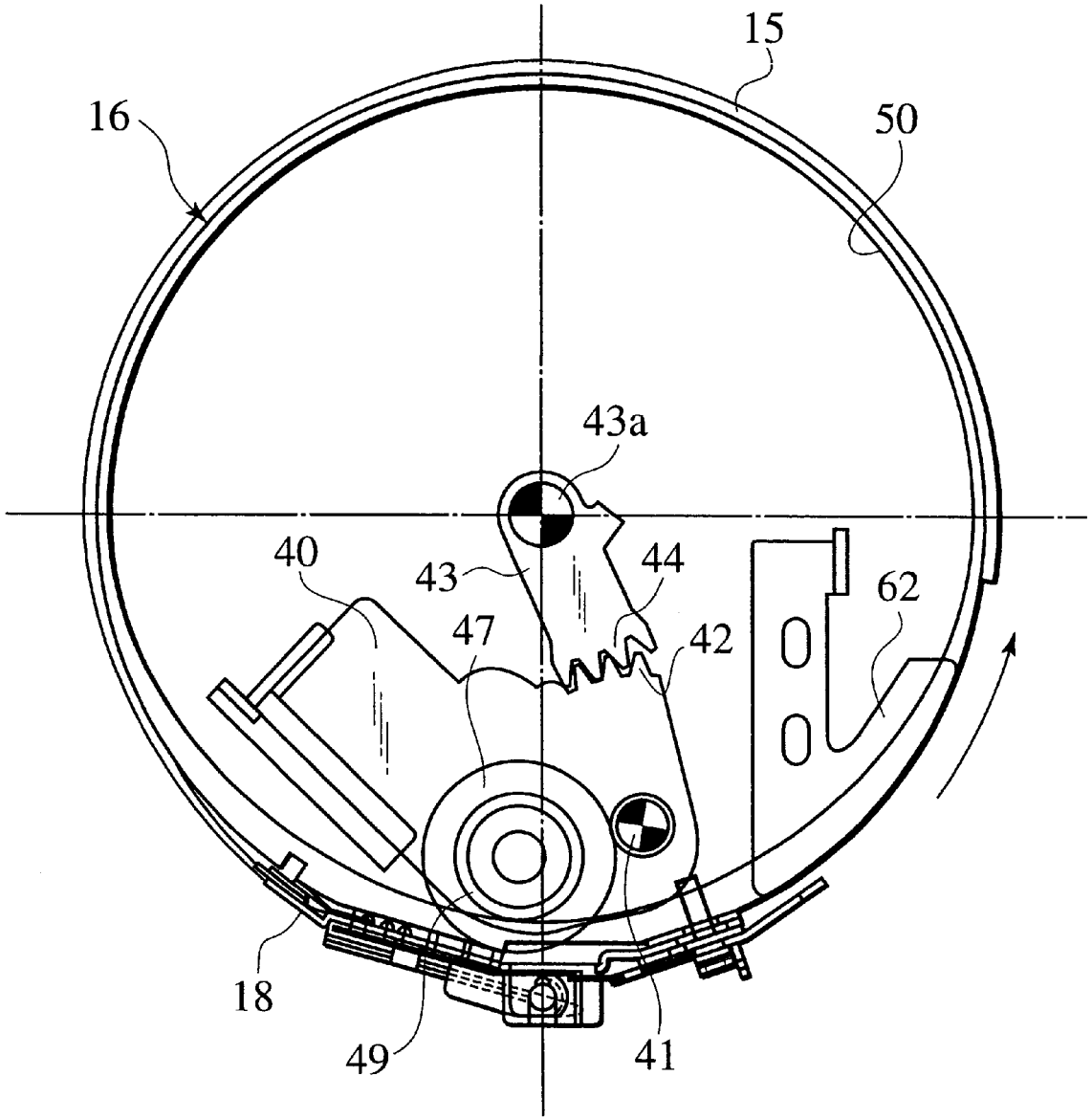
FIG. 12, which shows one embodiment of the present invention, is a structural side view showing the inside of the printing drum in which the inner pressing roll is located at a pressing position, and also in a state so as to avoid a stencil sheet clamp section.

When the inner arm portion 43 is rotated clockwise as shown in FIGS. 10 through 12, the roll support member 40 is allowed to pivot counterclockwise so that the inner pressing roll 47 is placed at a pressing position at which it presses the screen 19 forming the circumferential wall of the printing drum 16 onto the outer circumference side (state shown in FIG. 11), and when the inner arm portion 43 is rotated counterclockwise as shown in FIGS. 10 through 12, the roll support member 40 is allowed to pivot clockwise so that the inner pressing roll 47 is placed at a stand-by position at which it retreats inward from the screen 19 (state shown in FIG. 10).

A gear 45 is supported by the support shaft 41 so as to freely rotate thereon, and this gear 45 is engaged with an inner circumferential gear section 46 of the printing drum 16. The inner pressing roll 47 is supported on the roll support member 40 so as to freely rotate thereon, and a first gear 48 and a roller member 49 are secured to the respective ends of the inner pressing roll 47. The first gear 48 is engaged with the gear 45 of the support shaft 41 so that the inner pressing roll 47 is rotated in synchronism with the rotation of the printing drum 16. Moreover, in the case of the stand-by position of the inner pressing roll 47, the roller member 49 is placed at a position apart from the flange cam face 50 of the printing drum 16, and in the case of the pressing position, it is placed at a position in the proximity of the flange cam face 50 of the printing drum 16 or in press-contact therewith; thus, in the pressing position, the inner pressing roll 47 is allowed to move up and down along the flange cam face 50. The flange cam face 50 is arranged so that the diameters thereof from the rotation consists of a large-diameter range, a small-diameter range and a slanting range that continuously connect these ranges. Here, at the portion corresponding to the stencil sheet clamp section 18, the diameter from the rotation center is set in the small diameter range so that when the inner pressing roll 47 is positioned at the stencil sheet clamp section 18, it is placed apart therefrom so as not to cause any intervention; when it passes through the stencil sheet clamp section 18, the inner pressing roll 47 is returned to a position from which it presses the screen 19; and when it approaches the stencil sheet clamp section 18, a pressing start position and a pressing release position are placed at predetermined positions so that the inner pressing roll 47 is gradually separated from the screen 19. The following description will discuss the detailed positions of the pressing start position and pressing release position.

Figure 8:
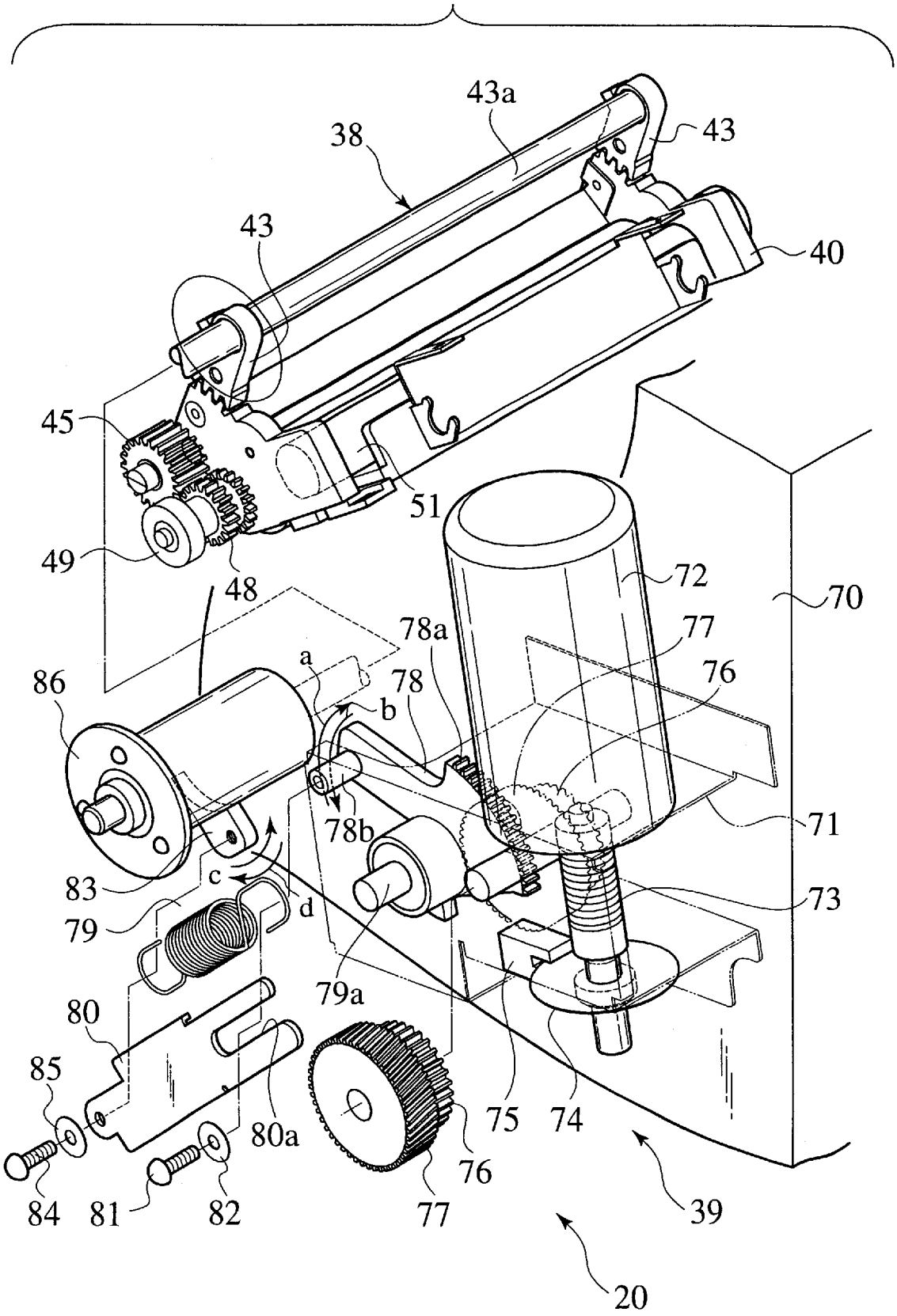
FIG. 8, which shows one embodiment of the present invention, is an exploded perspective view showing an inner press mechanism.

As shown in FIG. 8, the torque transmitting unit 39 is provided with a motor 72 secured to a mounting member 70 outside the printing drum 16 through a bracket 71, and a worm gear 73 is secured to the rotary shaft of the motor 72 and a rotation position detection disc 74 is also secured thereto. On the periphery of the rotation position detection disc 74, a rotation position detection sensor 75 is placed in the proximity thereof, and based upon the detection output of the rotation position detection sensor 75, the stroke of a spring 79, which will be described below, is calculated.

A worm wheel 77 is engaged with the worm gear 73, and a flat gear 76 is integrally secured to the worm wheel 77. The flat gear 76 is engaged with a teeth section 78*a* of an arm member 78 so that the arm member 78 is supported so as to freely pivot centered on a support shaft 79*a*. A spring hooking pin 78*b* is secured on the other end of the arm member 78 opposite to the teeth section 78*a*, and one end of the spring 79 is hooked on the spring hooking pin 78*b*. Moreover, the spring hooking pin 78*b* is inserted into a long groove 80*a* on one end of link plate 80, and the spring hooking pin 78*b* and the link plate 80 are stopped by a screw 81 and a washer 82 so as not to come off. The other end of the spring 79 and the other end of the link plate 80 are secured to an outer arm portion 83 with a screw 84 and a washer 85. The outer arm portion 83 is secured to the circumferential outer face of a rotation support body 86, and an engaging hole (not shown) to which the driving shaft 43*a* is inserted is formed in the rotation support body 86. The driving shaft 43*a* is inserted into the engaging hole so that the rotation of the rotation support body 86 is transmitted to the driving shaft 43*a*.

In other words, when the arm member 78 is allowed to pivot clockwise (in the direction of arrow a in FIG. 8) by the driving operation of the motor 72, the spring force of the spring 79 allows the outer arm portion 83 to rotate counterclockwise (in the direction of arrow c in FIG. 8) so that the inner pressing roll 47 is placed at the pressing position shown in FIGS. 11 and 12. A pressing force by the spring force of the spring 79 is always exerted on the inner pressing roll 47 at the pressing position, and this forms a printing pressure. Moreover, when the arm member 78 is allowed to pivot clockwise (in the direction of arrow b in FIG. 8) by the driving operation of the motor 72 so that the spring hooking pin 78*b* presses the bottom end face of the long groove 80*a* of the link plate 80, the link plate 80 presses the outer arm portion 83 so that the outer arm portion 83 is allowed to pivot clockwise (in the direction of arrow d in FIG. 8), with the result that the inner pressing roll 47 is placed at the stand-by position shown in FIG. 10.

Figure 9:
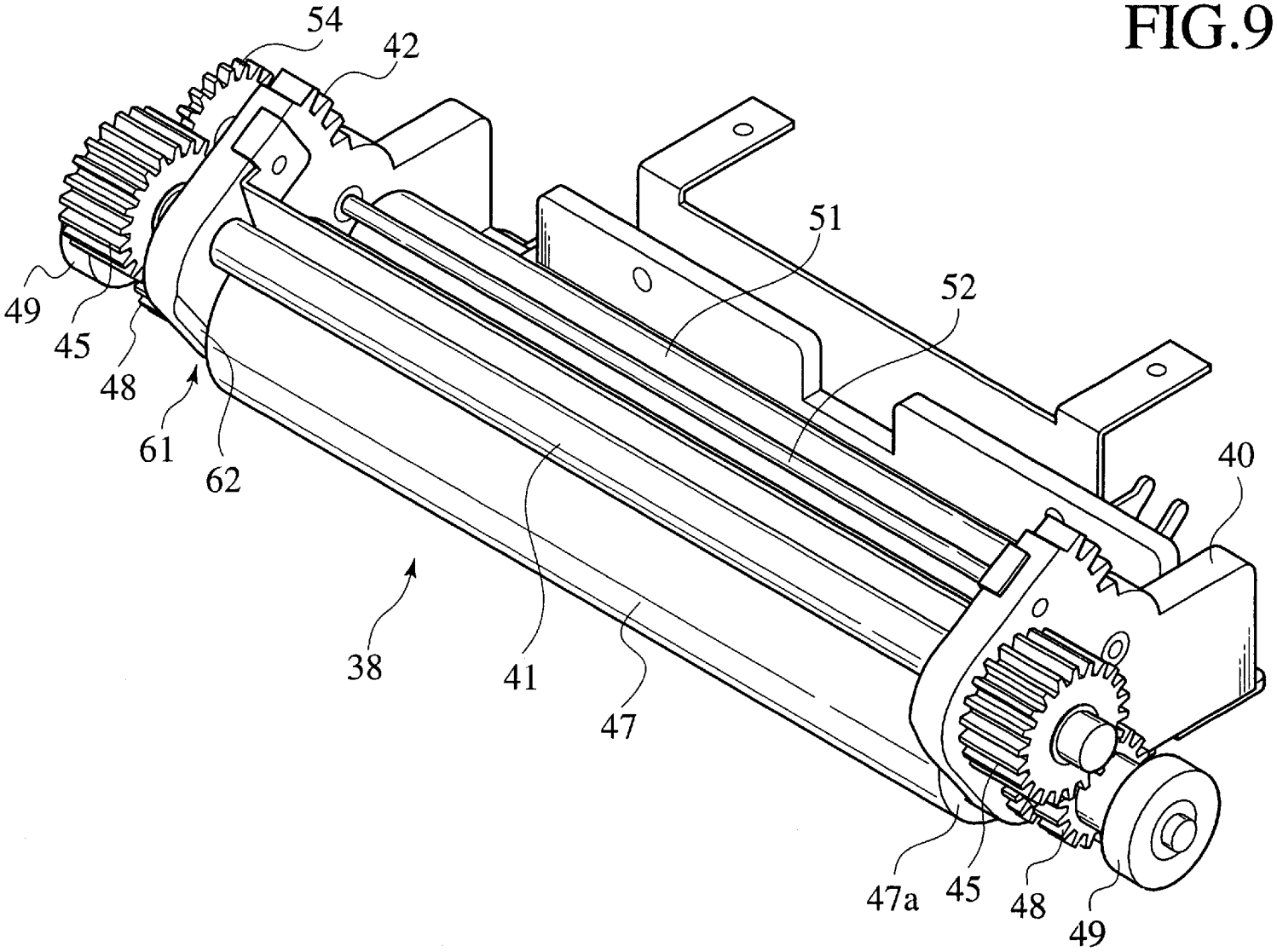
FIG. 9, which shows one embodiment of the present invention, is a perspective view showing an inner unit.
Figure 13:
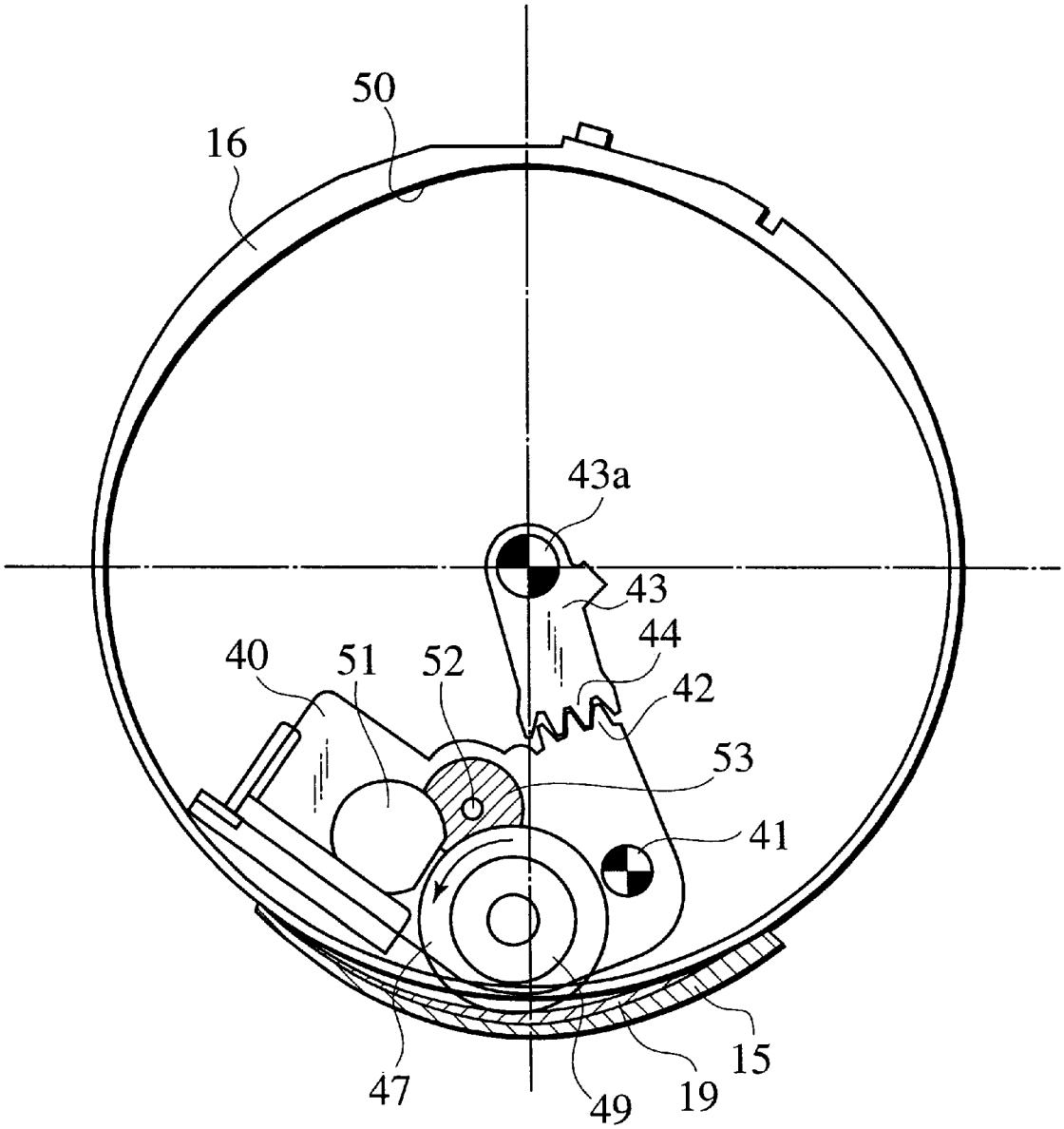
FIG. 13, which shows one embodiment of the present invention, is a structural side view showing the inside of the printing drum in which ink is supplied.

Moreover, as shown in FIGS. 9 and 13, a doctor roll 51 and a driving rod 52 are attached to the roll support member 40. The doctor roll 51 is secured to the roll support member 40 at a position in the proximity of the inner pressing roll 47. The driving rod 52 is supported by the roll support member 40 so as to freely rotate thereon, and placed in an upper space that is formed by the outer circumferential faces of the inner pressing roll 47 and the doctor roll 51 on the sides facing each other closely. Ink 53 is supplied to the upper space from an ink supplying section, not shown. A gear 54 is secured to one end of the driving rod 52, and this gear 54 is engaged with a second gear (not shown) of the inner pressing roll 47. The second gear (not shown) is supported on the shaft of the inner pressing roll 47 through a one-way clutch (not shown), and the driving rod 52 is rotated in synchronism with the printing drum 16 in the same manner as the aforementioned inner pressing roll 47.

When ink 53 is supplied to the upper space by the ink supplying section (not shown), the ink 53 is stirred by the driving rod 52, and of the stirred ink 53, some of ink 53 adhering to the outer circumferential face of the inner pressing roll 47 is apt to rotate together with the rotation of the inner pressing roll 47 due to its tackiness. Then, by making it pass through the gap against the doctor roll 51, only a predetermined amount of the ink 53 is always allowed to adhere thereto, and since the inner pressing roll 47 is made in press-contact with the screen 19 on the downstream side of the doctor roll 51, this predetermined amount of ink 53 is transferred onto the inner circumferential face of the screen 19. In other words, the inner pressing roll 47 has a function for applying the printing pressure to the screen 19 from inner circumferential side and also has a function for supplying ink 53 to the screen 19.

Figure 14:
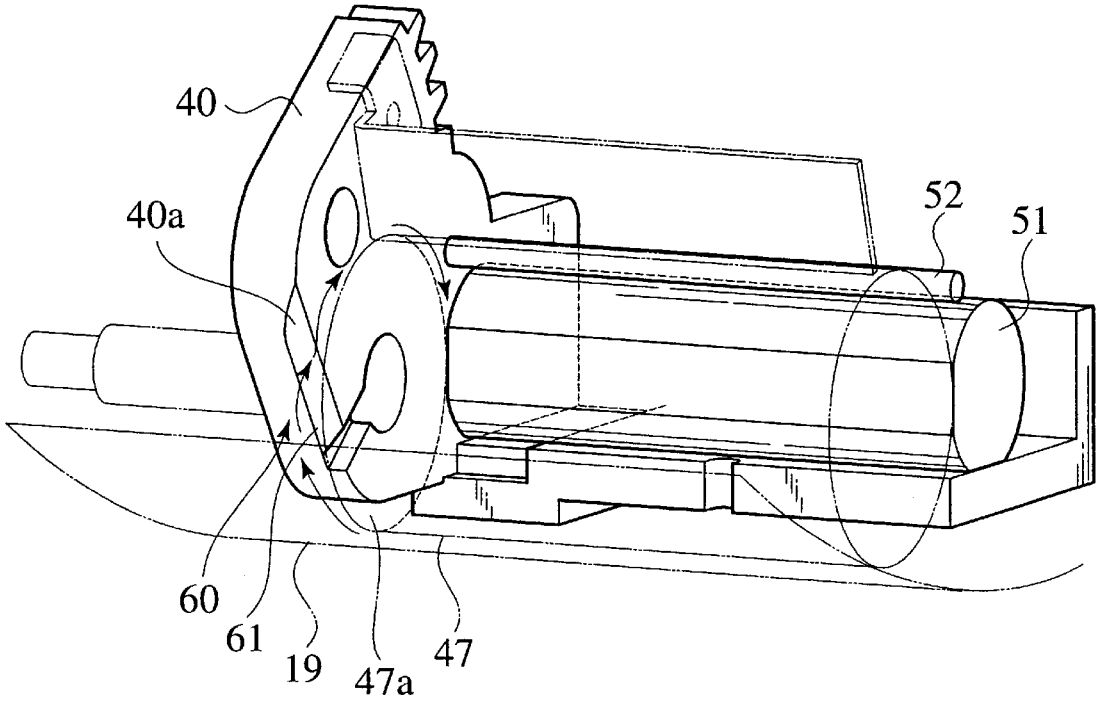
FIG. 14, which shows one embodiment of the present invention, is a perspective view showing an ink return unit in the vicinity of the end face of the inner pressing roll.

Moreover, as shown in FIGS. 9 and 14, ink returning unit 60 are respectively placed near both of the side end faces of the inner pressing roll 47. In the ink returning unit 60, each of portions of the roll support member 40 facing the side end faces 47*a* of the inner pressing roll 47 is formed into a cut face 40*a*, and this cut face 40*a* provides an ink passage 61 between the side end face 47*a* of the inner pressing roll 47 and the roll support member 40. The Ink 53 adhering to the side end face 47*a* of the inner pressing roll 47 that is shifted upward by the rotation of the inner pressing roll 47 is raised upward by the rotation of the inner pressing roll 47 through the ink passage 61, and the surface tension of the ink 53 thus raised upward serves to successively raise ink 53 located below, and the ink 53 is raised through the passage 61 and directed to the upper outer circumferential face side of the inner pressing roll 47.

Figure 15:
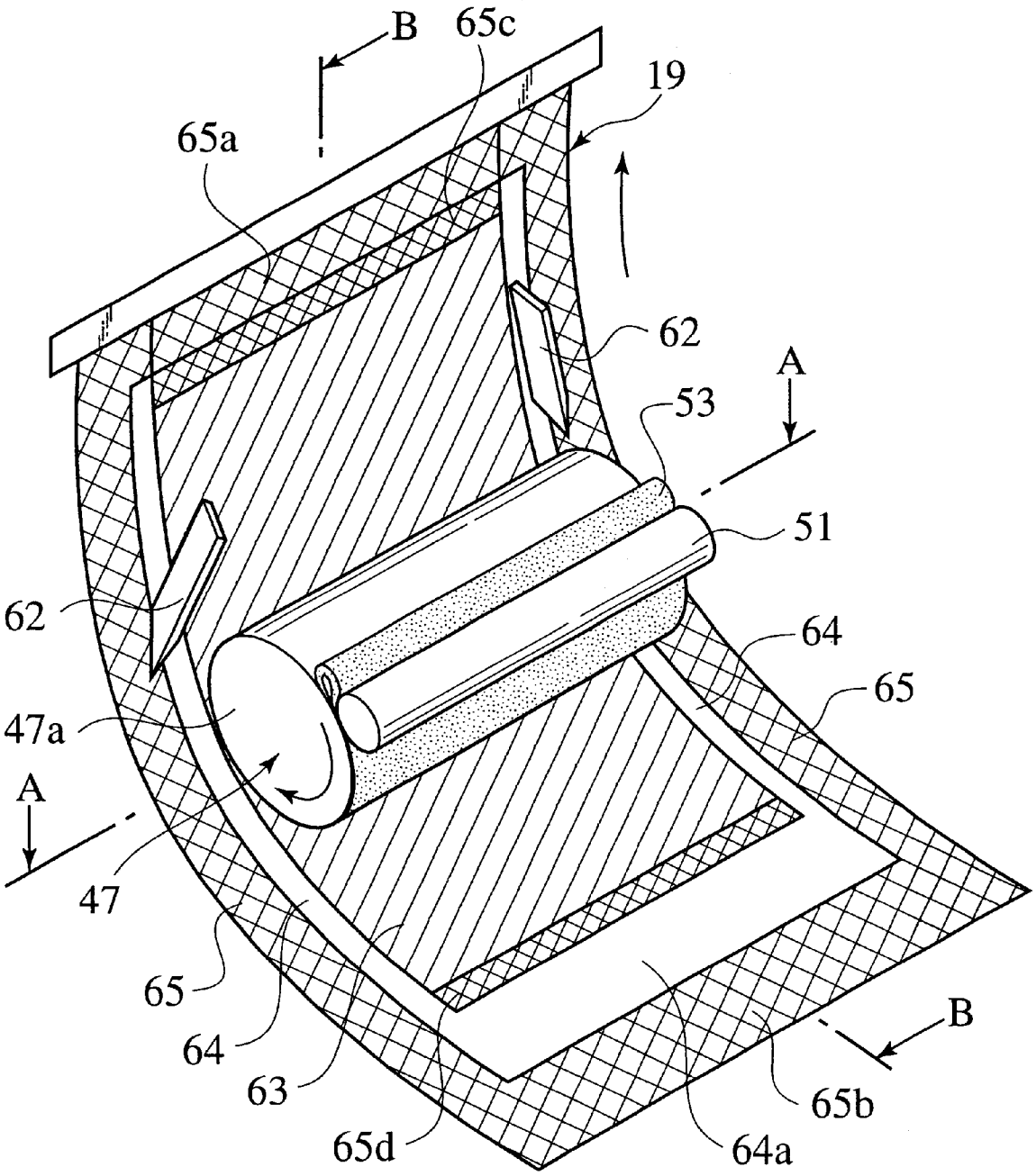
FIG. 15, which shows one embodiment of the present invention, is a perspective view showing members such as the inner pressure roll and a developed screen.

Moreover, as shown in FIGS. 10 through 12, a pair of right and left ink wiping members 62 are installed on the rotation downstream side of the screen 19 with respect to the inner pressing roll 47 inside the screen 19. As shown in FIG. 15, each of the ink wiping members 62 has its lower end made in press-contact with the ink non-passage section 65 of the screen 19 in a state where it is pressed by a pressing unit such as a spring so that its lower end is inclined in a direction so as to return ink 53 flowing over the ink non-passage section 65 to the ink free passage section 64.

Figure 16A:
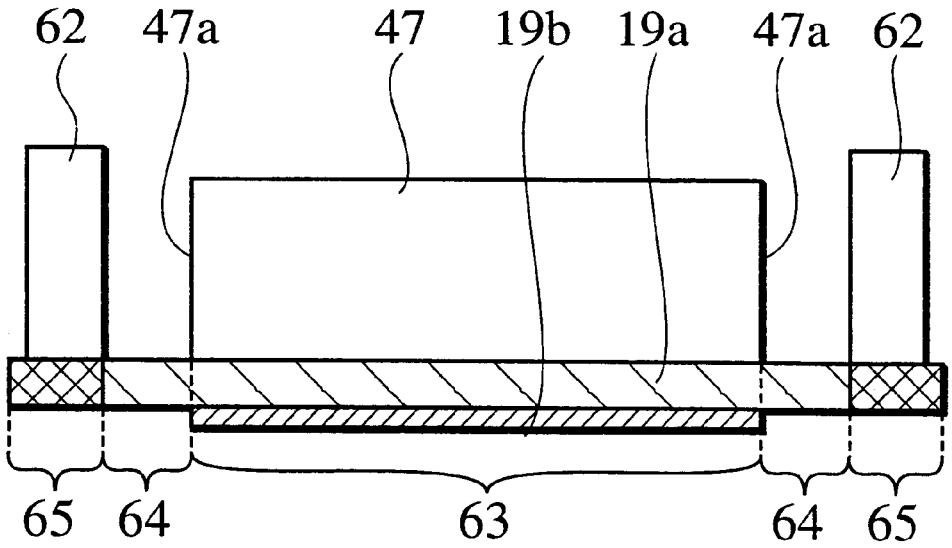
FIGS. 16A and 16B, which show one embodiment of the present invention.
Figure 16B:
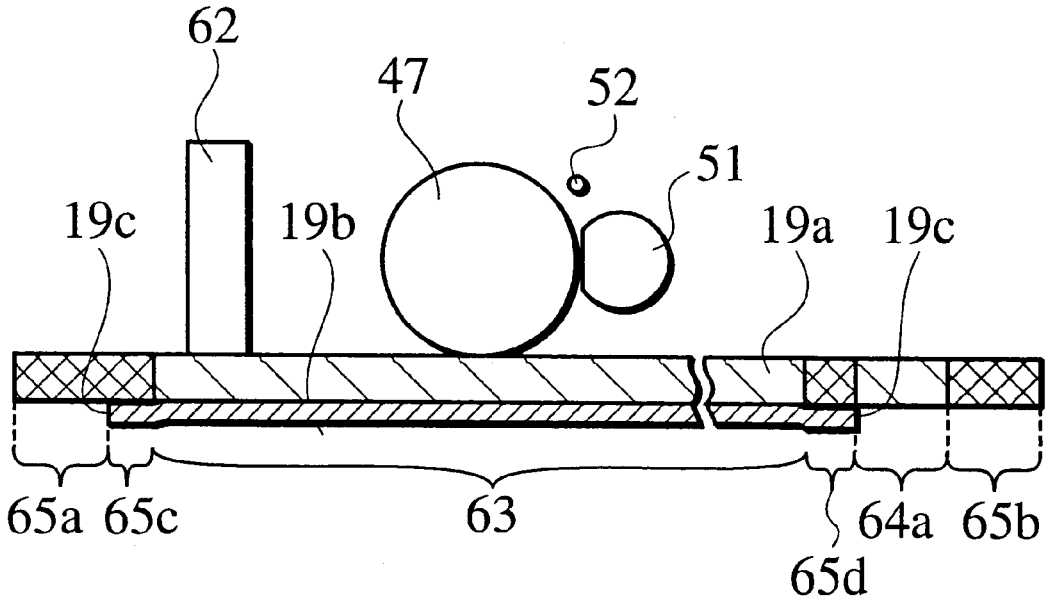

Next, a detailed explanation will be given of the screen 19 that forms the circumferential wall of the printing drum 16. FIG. 15 is a perspective view showing a developed state of the cylinder shaped printing drum 16, and FIG. 16A is a cross-sectional view taken along the line A—A of FIG. 15, and FIG. 16B is a cross-sectional view taken along the line B—B of FIG. 15. In FIGS. 15 and 16, the screen 19 is constituted by a rough mesh screen section 19*a* that allows ink 53 to pass through it without an application of a pressing force and a dense mesh screen section 19*b* that only allows ink 53 to pass through it when a pressing force is applied thereto. Here, an area on which the inner pressing roller 47 applies a pressing force is provided as a pressing-time ink passage section 63 (indicated by a diagonally hatched portion in FIG. 15) which is an overlapped portion of the rough mesh screen section 19*a* and the dense mesh screen section 19*b* and which allows ink 53 to pass through it only when the pressing force is exerted thereon. In both of the outside areas of the pressing-time ink passage section 63 in the center axis direction of the printing drum 16 that are not pressed by the inner pressing roll 106, only rough mesh screen sections 19*a* are formed so as to provide ink free passage sections 64 (indicated by white void portions in FIG. 15). In both of the further outside areas of the ink free passage section 64 and in the rotation uppermost stream side area and the rotation lowermost stream side area of the screen 19 that form a cylinder portion of the printing drum 16, a coating material is injected into the rough mesh screen section 19*a* so as to form these areas as ink nonpassage sections 65, 65*a* and 65*b* (indicated by cross hatched portions in FIG. 15) wherein ink 53 is not allowed to pass through them even when the pressing force is exerted thereon.

Moreover, the rotation uppermost stream side portion and the rotation lowermost stream side portion of the dense mesh screen section 19*b* are bonded to the rough mesh screen section 102*a* through a bonding section 19*c* by utilizing the coating material injected into the rough mesh screen section 19*a* as a bonding agent. Therefore, these portions are provided as ink non-passage sections 65*c* and 65*d* (indicated by crosshatched portions in FIG. 15).

Moreover, an ink free passage section 64*a* (indicated by a white void portion in FIG. 15) is formed between the ink non-passage section 65*d* that is the rotation lowermost stream side portion of the dense mesh screen section 19*b* and the ink non-passage section 65*b* that is the rotation lowermost stream side of the rough mesh screen section 19*a*.

Figure 17:
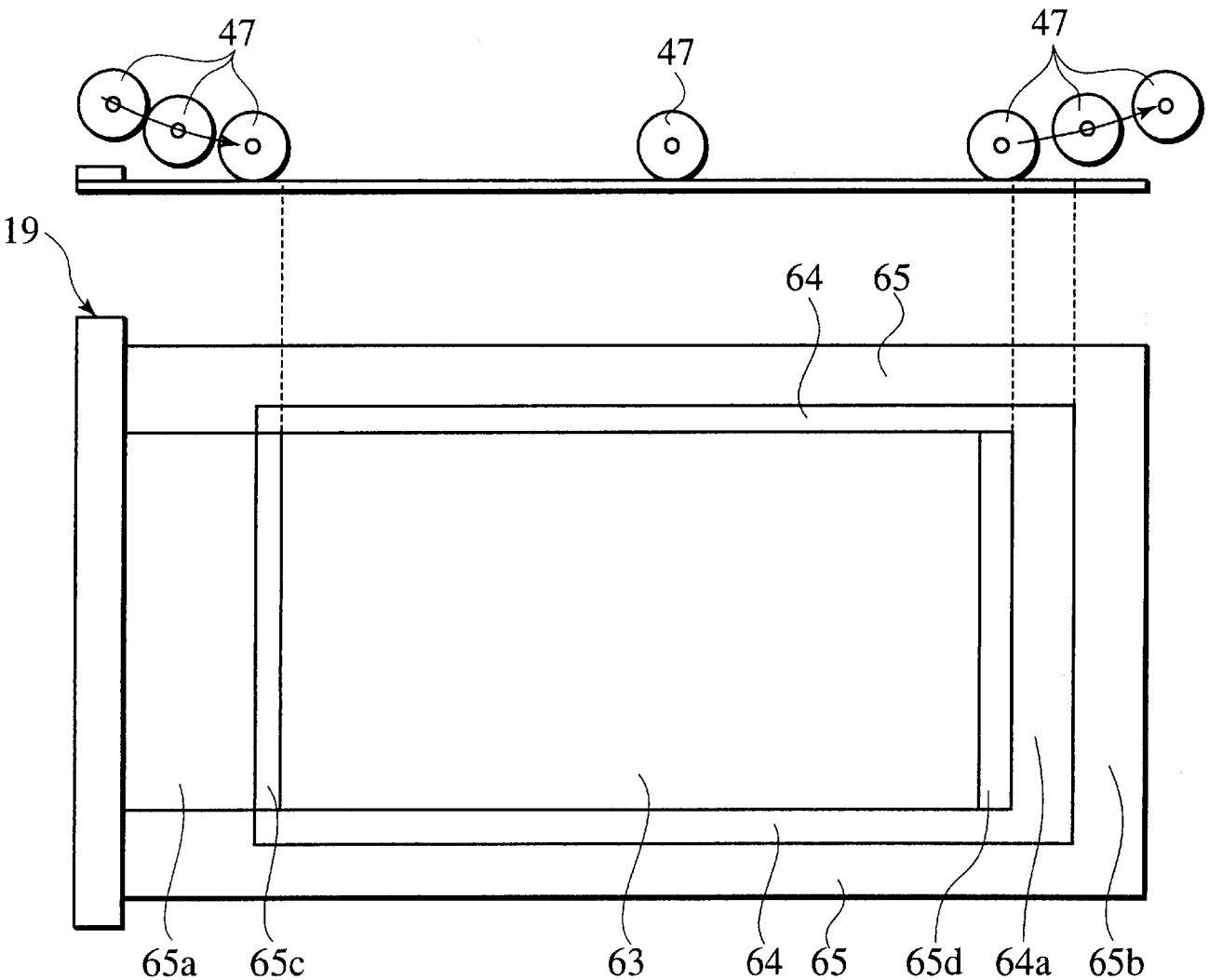
FIG. 17, which shows one embodiment of the present invention, is a diagram showing the locus of a relative shift of the inner pressing roll with respect to the screen.

Next, an explanation will be given of a position at which the inner pressing roll 47 starts a pressing operation onto the screen 19 and a position at which this pressing operation is removed. FIG. 17 is a diagram showing the locus of a relative shift of the inner pressing roll 47 with respect to the screen 19. In FIG. 17, when the inner pressing roll 47 is rotated beyond the position (corresponding to the stencil sheet clamp section 18) at which the inner pressing roll 47 is separated from the inner circumferential face of the screen 19, the inner pressing roll 47 gradually approaches the inner circumferential face of the screen 19 and comes into contact with it; and in this case, the position at which the pressing operation is started by using a predetermined force is set to be located at least on the upstream side of the pressing-time ink passage section 63. In other words, it is set to be located at the ink non-passage section 65*a* and 65*b* of the screen 19. Then, from the state in which it is pressing the screen 19 with a predetermined pressing force, the inner pressing roll 47 gradually decreases its pressing force, and the inner pressing roll 47 is separated from the screen 19 to completely release its pressing force; and in this case, this pressing force releasing position is set to be located at the ink free passage section 64*a*.

Next, a brief explanation will be given of the operation of the stencil printing machine 1. In the stencil making section 3, the platen roller 13 and the stencil sheet feeding roller 14 are rotated so that the elongated stencil sheet 10 is transported, and based upon image information read at the document reading section (not shown), the respective heat-generating elements of the thermal head 12 are selectively allowed to generate heat so that the elongated stencil sheet 10 is perforated through the heat-sensitive process; thus, the elongated stencil sheet 10, subjected to the stencil making process, corresponding to one-stencil length is cut with a stencil sheet cutter (not shown) so as to form a stencil sheet. 15.

In the printing section 4, the leading edge of the stencil sheet 15 subjected to the stencil making process at the stencil making section 3 is clamped at the stencil sheet clamp section 18, and in this clamped state, the printing drum 16 is rotated so that the stencil sheet 15 is wrapped around and attached to the outer circumferential face of the screen 19 that forms the circumferential wall of the printing drum 16.

In the paper-feeding section 5, a sheet of printing paper 22 is transported in synchronism with the rotations of the printing drum 16 and the pressure drum 17, and then transported between the printing drum 16 and the pressure drum 17 with the leading edge of the sheet of printing paper 22 being clamped at the paper clamp section 21 of the pressure drum 17.

In the printing section 4, the inner pressing roll 47 is maintained at a stand-by position as shown in FIG. 10 in cases other than the printing process; thus, the inner pressing roll 47 is placed at a position apart from the screen 19. In the case of the printing process, the inner pressing roll 47 is placed at the pressing position and the printing drum 16 is rotated. Then, the inner pressing roll 47 is rotated on the inner circumferential face of the screen 19 while the inner pressing roll 47 is pressing the inner circumferential side of the screen 19, as shown in FIG. 11, except that at the periphery of the stencil sheet clamp section 18 it is placed at a retreated position, as shown in FIG. 12. Since ink 53 is continuously supplied onto the outer circumferential face of the inner pressing roll 47, this rotation transfers the ink 53 onto the screen 19. Moreover, the pressing force of the inner pressing roll 47 makes the screen 19 extend on the outer circumferential side so as to come Into contact with the pressure drum 17. Then, the sheet of printing paper 22 is transported between the printing drum 16 and the pressure drum 17 from the paper-feeding section 5 as described above, and the sheet of printing paper 22 thus transported is further transported while being pressed together with the screen 19 and the stencil sheet 15 between the inner pressing roll 47 and the pressure drum 17. In this pressing process, the ink 53 is transferred on the sheet of the printing paper 22 through the perforated portion of the stencil sheet 15 so that an image is formed. When the leading edge of the sheet of printing paper 22 passes through the position of the inner pressing roll 47 and comes to the downstream side, the paper clamp section 21 releases the leading edge thereof.

In the paper discharging section 6, the leading edge side of the sheet of printing paper 22 is guided by the upper regulating guide section 30, or the leading edge side of the sheet of printing paper 22 is scraped from the pressure drum 17 by the sheet separator claw 32, and this is transported to the stacker section 34 through the paper-transporting mechanism 33.

Moreover, in the stencil disposal section 7, upon starting a new stencil making process, it is necessary to remove the stencil sheet 15 wrapped around and attached to the outer circumferential face of the screen 19 of the printing drum 16, that has been used in the previous printing process; therefore, in this case, prior to the step for wrapping a new stencil sheet that has been subjected to a stencil making process around the outer circumferential face of the circumferential wall of the printing drum 16 so as to be attached thereto, the stencil sheet clamp section 18 of the printing drum 16 is released, and the leading edge of the stencil sheet 15 thus released is directed by the discharge stencil guiding belt 35 while the printing drum 16 is being rotated, and transported by the pair of discharge stencil conveyor belts 36 and housed in the discharge stencil box 37.

In the above-mentioned printing operation, the ink 53, supplied to the screen 19, is applied onto the inner circumferential face of the rough mesh screen section 19*a*, and also injected inside the rough mesh screen 19*a*, between the rough mesh screen section 19*a* and the dense mesh screen section 19*b*, and between the dense mesh screen section 19*b*, and the stencil sheet 10. Here, the ink behaves so as to avoid the pressing force exerted between the inner pressing roll 47 and the pressure drum 17.

Figure 18:
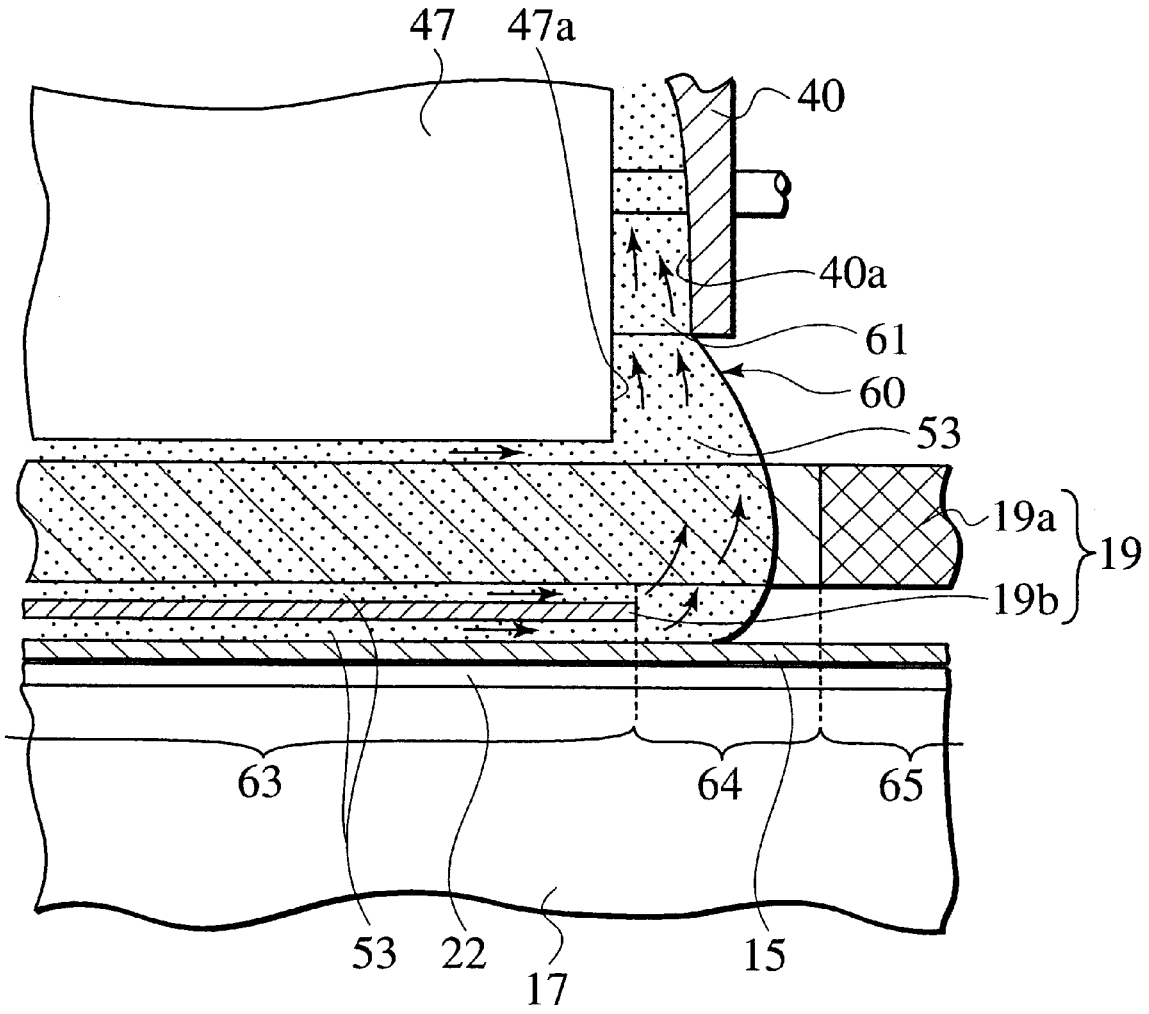
FIG. 18, which shows one embodiment of the present invention, is a cross-sectional view of an essential portion showing a state in which escape ink is directed to the inner circumferential side of the ink free passage portion of the screen and the ink is allowed to rise through the ink passage.

More specifically, as shown in FIG. 18, some ink 53 located between the rough mesh screen section 19*a* and the dense mesh screen section 19*b* and some ink 53 located between the dense mesh screen section 19*b* and the stencil sheet 15 are not blocked in their shift outward in the axis direction of the inner pressing roll 47, and allowed to escape to the outsides of the inner pressing roll 47 in the axis direction. When they reach the outer circumferential face of the ink free passage section 64 of the screen 19 at which no pressing force from the inner pressing roll 47 is exerted, the escape ink 53 is allowed to pass through the ink free passage section 64 by a pressing force from the pressure drum 17, and directed to the inner circumferential side of the screen 19. Therefore, it is possible to prevent the leakage ink 53 from reaching the right and left ends of the stencil sheet, and consequently to eliminate the limitation to the number of prints in endurance printing processes that is imposed due to ink leakage from the stencil. Moreover, since it is not necessary to form a raised portion along the screen, which has been required in conventional arrangements, the screen 19 can be easily manufactured at low costs.

Moreover, in the present embodiment, as shown in FIG. 18, some ink 53, located between the inner pressing roll 47 and the rough mesh screen section 19*a*, also is not blocked in its shift outward in the axis direction of the inner pressing roll 47, and allowed to escape to the outsides of the inner pressing roll 47 in the axis direction. Then, the ink 53, escaped from the inner circumferential side and the outer circumferential side of the screen 19, is accumulated on the inner circumferential face of the ink free passage section 64, that is, in the vicinity of each of the side end face 47*a* of the inner pressing roll 47. Of the accumulated leakage ink 53, the ink 53 adhering to the side end faces 47*a* of the inner pressing roll 47, is raised upward by the rotation of the inner pressing roll 47, and allowed to rise through the ink passage 61, and the surface tension of the ink 53 thus raised upward serves to raise ink 53 located below successively so that this ink 53 is allowed to rise through the ink passage 61, and directed to the upper outer circumferential face side of the inner pressing roll 47. The ink 53, thus directed to the upper outer circumferential face side of the inner pressing roll 47, is again supplied to the screen 19 by the rotation of the inner pressing roll 47. Therefore, it is possible to solve problems, such as stains inside the machine due to ink leakage on the inner circumferential face of the screen 19.

Moreover, in the present embodiment, the ink 53 flowing to reach the ink non-passage section 65 further outside from the ink free passage section 64 of the screen 19 is wiped by the ink wiping member 62, and returned to the ink free passage section 64; therefore, it Is possible to positively solve problems, such as stains inside the machine due to ink leakage on the inner circumferential face of the screen 19.

Additionally, in the arrangement of the present embodiment, with respect to the ink return unit 60, the ink passage 61 is installed and the ink 53 is allowed to shift upward onto the inner pressing roll 47 through the ink passage 61 by utilizing the rotation of the inner pressing roller 47 and the surface tension of the ink 53; however, any means other than the surface tension, such as an ink suction process, may be utilized, and with respect to the return position of the ink 53, not limited to the upper outer circumferential face of the inner pressing roll 47, any position may be used as long as it allows the ink 53 reused. In other words, any means may be used as long as it allows the ink 53 accumulated on the inner face side of the ink free passage section 64 of the screen 19 to be reused.

Various modifications will become possible for those skilled in the art after receiving the teachings of the present disclosure without depending from the scope thereof.

What is claimed is:

1. A stencil printing machine comprising:

a printing drum rotatable about an axis and having an outer circumferential wall having an inner face and an outer face, said outer circumferential wall defining an interior space in said printing drum, said outer face adapted to detachably receive a stencil sheet;

a rotatable pressure drum axially parallel to said printing drum, said pressure drum having an outer circumferential face having a portion thereof disposed close to said outer face of said printing drum and forming a nip therebetween; and a rotatable inner pressing roll having an outer circumferential face disposed axially parallel to said printing drum, in said interior space, and that can supply an ink from said inner circumferential face side of said circumferential wall, a portion of said inner pressing roll being pressed against a portion of said inner circumferential face of said circumferential wall so that the stencil sheet attached to said circumferential wall and a printing medium passing through the stencil sheet and said pressure drum contact each other;

said circumferential wall further comprising:

a centrally disposed first portion through which the ink can pass only in an area where said inner pressing roll applies a pressure to said inner face, said first portion having a periphery;

a second portion disposed axially to said first portion and outside the periphery thereof, said second portion being adapted so that the ink can freely pass there-through, said second portion having an axially outer peripheral side; and a third portion disposed axially to said second portion and outside the outer peripheral side thereof, said third portion being adapted so that the ink can not pass there-through.

2. The stencil printing machine of claim 1, further comprising:

an ink return unit for returning the ink from an area of said inner face of said circumferential wall near said second portion to a position at which the ink can be reused.

3. The stencil printing machine of claim 2, wherein the ink return unit comprises:

an ink passage between a supporting member of said inner pressing roll and a side end face of said inner pressing roll, wherein the ink adhering to said side end face is raised upward by a rotation of said inner pressing roll and allowed to rise through said ink passage, and whereby surface tension of the ink thus raised upward successively raises the ink located there-below, and is directed to above said outer circumferential face side of said inner pressing roll.

4. The stencil printing machine of claim 1, further comprising:

an ink wiping member disposed in said interior space of said printing drum, on a rotation downstream side thereof with respect to said inner pressing roll, and which returns the ink from said third portion to said second portion.

5. A stencil printing machine comprising:

a printing drum rotatable about an axis and having an outer circumferential wall with an inner face and an outer face, said outer circumferential wall defining an interior space in said printing drum, said outer face being adapted to detachably receive a stencil sheet; and a rotatable inner pressure roll having an outer face that can supply an ink, said inner pressure roll disposed axially parallel to said printing drum, in said interior space thereof, a portion of said outer face of said inner pressure roll pressingly in contact with a portion of said inner face of said circumferential wall; said circumferential wall further comprising:

a centrally disposed first portion through which the ink can pass only in an area where said inner pressure roll applies a pressure to said inner face, said first portion having a periphery;

a second portion disposed axially to said first portion and outside the periphery thereof, said second portion being adapted so that the ink can freely pass there-through, said second portion having an axially outer peripheral side; and a third portion disposed axially to said second portion and outside the outer peripheral side thereof, said third portion being adapted so that the ink can not pass there-through.

6. The stencil printing machine of claim 5, further comprising:

an ink return unit for returning the ink from an area of said inner face of said circumferential wall near said second portion to a position at which the ink can be reused.

7. The stencil printing machine of claim 6, wherein the ink return unit comprises:

an ink passage between a supporting member of said inner pressing roll and a side end face of said inner pressing roll, wherein the ink adhering to said side end face is raised upward by a rotation of said inner pressing roll and allowed to rise through said ink passage, and whereby surface tension of the ink thus raised upward successively raises the ink located there-below, and is directed to above said outer circumferential face side of said inner pressing roll.

8. The stencil printing machine of claim 5, further comprising:

an ink wiping member disposed in said interior space of said printing drum, on a rotation downstream side thereof with respect to said inner pressing roll, and which returns the ink from said third portion to said second portion.

* * * * *